United States Patent [19]

Lattion

[11] Patent Number: 4,655,665

[45] Date of Patent: Apr. 7, 1987

[54] BOBBIN MAGAZINE FOR A TRAVELLING SERVICE DEVICE OF A YARN PROCESSING MACHINE

[75] Inventor: Andre Lattion, Seuzach, Switzerland

[73] Assignee: Machinenfabrik Rieter AG, Winterthur, Switzerland

[21] Appl. No.: 698,628

[22] Filed: Feb. 6, 1985

[51] Int. Cl.[4] ..... B65H 67/06

[52] U.S. Cl. ..... 414/112; 57/270; 57/276; 221/11; 221/281; 242/35.5 A

[58] Field of Search ..... 414/112, 330; 221/11, 221/104, 105, 97, 281; 57/270, 276; 242/35.5 A

[56] References Cited

U.S. PATENT DOCUMENTS

| | | | |
|---|---|---|---|
| 2,437,425 | 3/1948 | Goodhue et al. | 221/281 X |
| 2,886,940 | 5/1959 | Urano et al. | 242/35.5 A X |
| 3,082,908 | 3/1963 | Ingham | 57/270 X |
| 3,154,909 | 11/1964 | Urano et al. | 57/270 X |
| 3,939,634 | 2/1976 | Yoshizawa et al. | 242/35.5 A X |
| 4,066,218 | 1/1978 | Kamp | 242/35.5 A |
| 4,564,123 | 1/1986 | Noshi | 221/11 |

FOREIGN PATENT DOCUMENTS

| | | | |
|---|---|---|---|
| 0126373 | 11/1984 | European Pat. Off. . | |
| 0126352 | 11/1984 | European Pat. Off. . | |
| 0127017 | 12/1984 | European Pat. Off . | |
| 2131957 | 2/1973 | Fed. Rep. of Germany | 242/35.5 A |
| 2129451 | 5/1984 | United Kingdom | 242/35.5 A |

OTHER PUBLICATIONS

Festo Penumatic-Doppelwirkenden Zylinder, Pneumatische Linearantriebe.

P. W. Harrison, Rotor-Spinning, Textile Progress, vol. 13, No. 4, pp. 7-9.

*Primary Examiner*—Leslie J. Paperner

*Attorney, Agent, or Firm*—Michael J. Striker

[57] ABSTRACT

A travelling service device of a yarn processing machine is equipped with a bobbin magazine for receiving a multitude of sticks of conical bobbin tubes which are telescopically nested within one another. The magazine includes a conveyor belt which extends along and can be moved in an endless path and which carries a multitude of bounding elements which bound respective compartments, each for receiving one of the sticks for movement with the belt. At a predetermined location of the endless path, there is provided an arrangement for removing the respective stick from the associated compartment, and for transferring such stick to an arrangement for separating the individual tubes from the stick for subsequent feeding to the respective station of the machine. The compartments may be arranged so that their axes extend normal to the trajectory of movement of the travelling service device, in whic case the removing arrangement includes an arrangement for turning te stick through 90° in a horizontal plane before the transfer to the separating arrangement, or so that their axes are parallel to the trajectory, in which case no such turning arrangement is needed. The magazine may be hingedly mounted on the service device for displacement between two end positions in one of which it conceals, and in the other of which it exposes, an end wall of the service device.

10 Claims, 14 Drawing Figures

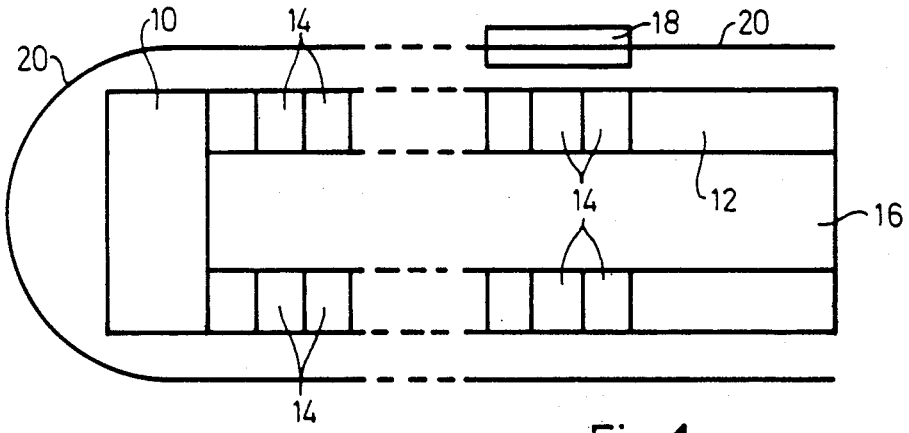
Fig.1
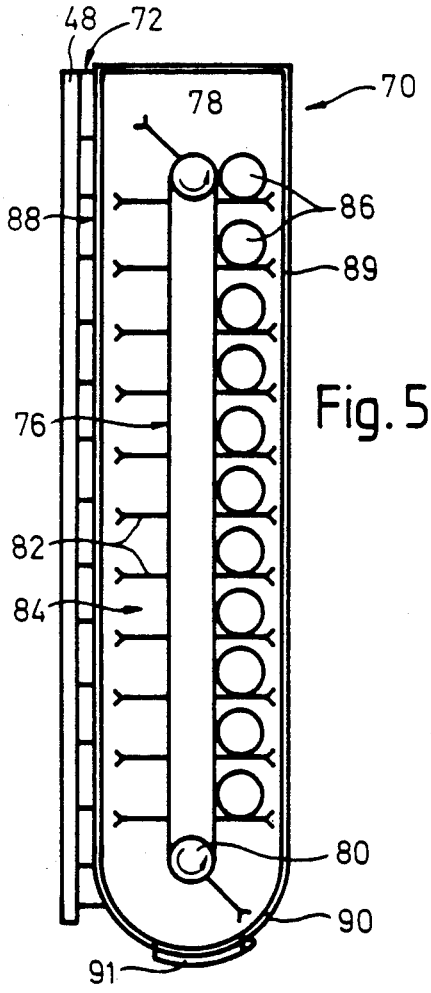
Fig.5A
Fig.5B
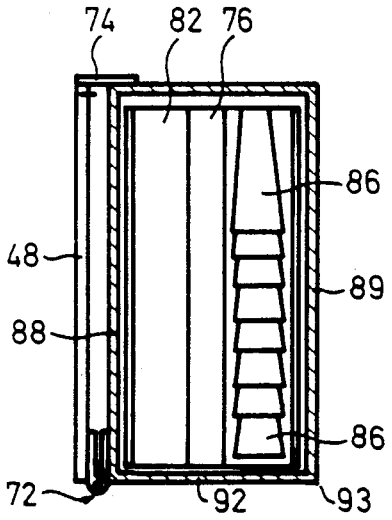

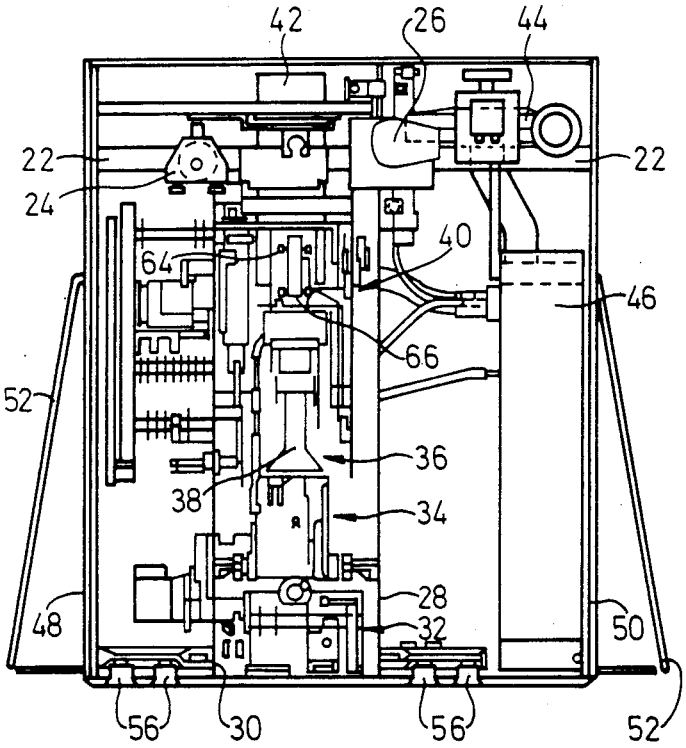
Fig. 2
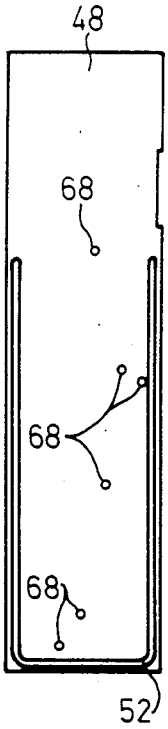
Fig. 4
Fig. 3
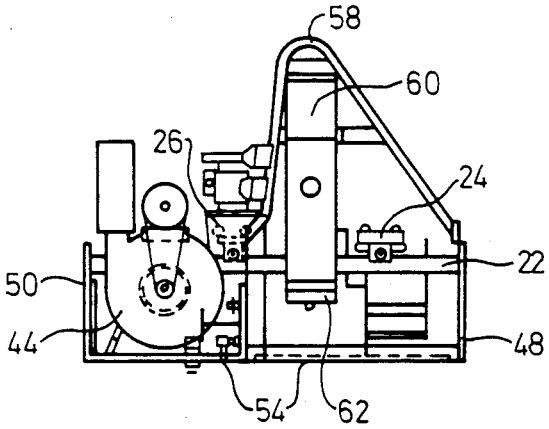

Fig. 6A
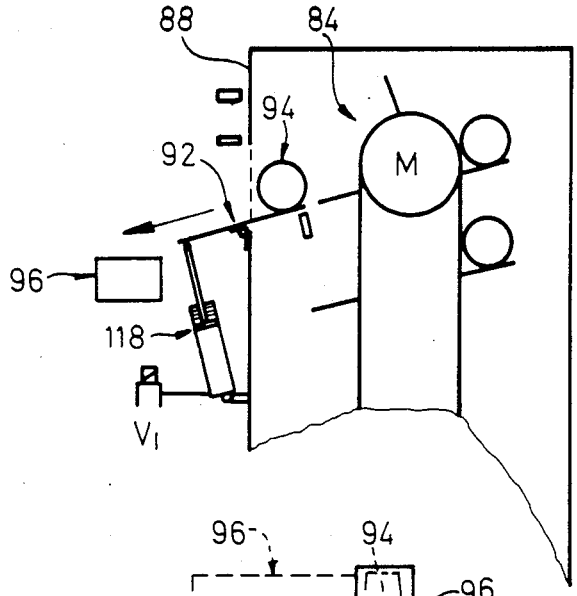
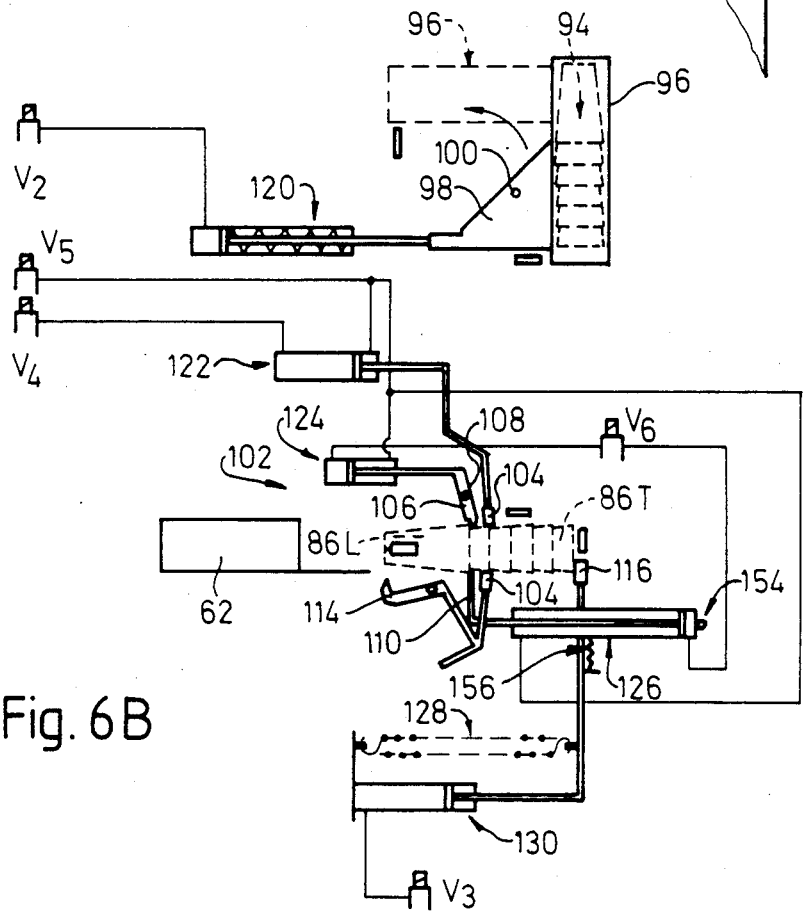
Fig. 6B

BOBBIN MAGAZINE FOR A TRAVELLING SERVICE DEVICE OF A YARN PROCESSING MACHINE

BACKGROUND OF THE INVENTION

The present invention relates to bobbin magazines for use with a travelling service device for servicing operating stations of a yarn processing machine. The invention is intended particularly, but not exclusively, for use in connection with travelling doffers for open-end spinning machines, for example rotor spinning machines.

Travelling doffers for use on rotor spinning machines are now very well known, being offered virtually as standard equipment on the rotor spinning machines exhibited at the International Textile Machinery Exhibition held in Milan, Italy in October 1983. It is therefore believed unnecessary to provide a detailed description of such doffers here. Broadly, their function is to patrol back and forth past the individual spinning stations of the rotor spinning machine and, when a yarn package of predetermined size has been produced at one particular spinning station, to stop in front of that spinning station, transfer the completed package from the package holder of the spinning station to a suitable package transporting means, (for example a conveyor belt extending longitudinally of the central portion of the machine) and to insert a fresh bobbin tube into the package holder of the spinning station so that yarn newly spun at that spinning station can be wound up on the fresh bobbin tube.

Various systems have been proposed for providing a fresh bobbin tube in readiness for a doffing operation. The present invention relates to systems in which the travelling doffing device carries its own bobbin magazine so that during its patrolling movements the doffing device carries a stock of bobbin tubes, the maximum size of which is limited only by the capacity of the magazine.

It is normally relatively easy to provide a bobbin magazine for a rotor spinning machine which produces cylindrical packages or "cheeses". These are produced on cylindrical bobbin tubes which can be made to roll in a substantially predetermined fashion in and from the magazine. Furthermore, such bobbin tubes can be made substantially symmetrical about their middle section so that there is no left-hand/right-hand problem during the transfer of a bobbin tube to a spinning station. Accordingly, there is generally no need to provide complicated feed equipment in association with magazines for cylindrical bobbins, and the available space on the doffer can be used efficiently for bobbin storage.

However, problems arise when the rotor spinning machine produces frusto-conical ("conical") packages which are produced on correspondingly conical bobbin tubes. Such conical tubes do not roll in a readily controllable manner, and they must be inserted into the spinning station with a specific longitudinal orientation. A bobbin magazine for conical bobbins is therefore generally more complex than a magazine for cylindrical bobbins, and a given amount of storage space can generally be used less efficiently for conical bobbins than for cylindrical bobbins. This can be of a special importance where a travelling doffer is designed to be adaptable for use selectively with cylindrical or conical packages.

When the rotor spinning machine performs its normal operation, doffing operations will be called for at some statistically calculable average frequency so that the capacity of the doffer magazine is sufficient for a corresponding period of operating time. However, the doffer may also be designed for multipurpose operation, and in particular for automatic start-up of the machine. In such circumstances all of the package holders in the spinning machine may be empty at the beginning of the start-up operation and the doffer may be required to insert a bobbin tube into the package holder of each spinning station in succession as a part of its start-up sequence at that station. The frequency of demand for fresh bobbins tubes will be much higher during the start-up operation than during normal operation, and the capacity of the magazine which is adequate for normal operation may produce a very long start-up operation for the machine as a whole due to the need for frequent topping-up or filling of the bobbin magazine. Proposals have therefore already been made to use sticks of telescoped or nested conical bobbin tubes to improve efficiency of space utilization in bobbin magazines. U.S. Pat. No. 4,066,218 proposes a system in which a bobbin magazine on the doffer consists of a single stick of telescoped tubes, and an automatic loading device provided at one end of the machine comprises an elevator adapted to receive a plurality of sticks of tubes and to transfer them one by one to the doffer magazine as and when called for. The axes of the bobbin tubes are aligned along the length of the machine in both the doffer magazine and the loading station elevator.

German Published Patent Application No. 2,131,957 describes a doffer magazine in which a plurality of sticks of telescoped bobbin tubes can be mounted in respective compartments of a carousel-like device rotatable about an axis parallel to the axes of the bobbin tubes in the sticks. The device can be rotated to bring the sticks successively into alignment with a separating station at which individual tubes can be separated from the stick currently aligned with the separating station. The mounting of this magazine in the doffer is not shown, but the sticks of tubes are disposed vertically in the magazine, and accordingly the individual tubes would normally have to be re-oriented after leaving the magazine before insertion in a spinning station in which the bobbin axes are normally disposed horizontally. Accordingly, neither of the above publications shows a simple system providing for an efficient use of the available storage space.

SUMMARY OF THE INVENTION

Accordingly, it is a general object of the present invention to avoid the disadvantages of the prior art.

More particularly, it is an object of the present invention to provide a travelling service device for servicing the operating stations of a yarn processing machine which does not possess the disadvantages of the conventional devices of this type.

Still another object of the present invention is so to construct the device of the type here under consideration as to have a sufficient capacity for accommodating conical bobbin tubes even for the start-up of the yarn processing machine.

It is yet another object of the present invention so to construct the bobbin tube magazine as to form an addition to an existing service device and yet not to interfere with the operation of or access to various parts of such device.

A concomitant object of the present invention is so to construct the device of the type here under consideration as to be relatively simple in construction, inexpensive to manufacture, easy to install and use, and reliable in operation nevertheless.

In pursuance of these objects and others which will become apparent hereafter, one feature of the present invention resides in a travelling service device for servicing operating stations of a yarn processing machine, comprising support means which is mounted on guiding means for travel in a predetermined trajectory along the operating stations and is moved, as needed, in such trajectory into predetermined positions at the operating stations by moving means. The device comprises means bounding a plurality of compartments, and each compartment is adapted to receive a stick of telescoped nested conical bobbin tubes. Each compartment may be so disposed that in use the longitudinal axes of the tubes of a stick contained therein extend substantially horizontally and transversely to the trajectory. Alternatively, each compartment may be so disposed that in use the longitudinal axes of the tubes of a stick contained therein extend substantially horizontally and parallel to the trajectory.

Displacing means are provided for displacing the compartments in a closed path, the movement of the compartments along this path being along a plane that is transverse to the longitudinal axes of the sticks contained in the compartments. The path is preferably elongated and extends substantially vertically in use. The means that bounds the compartments and the means for displacing the same around the closed path may be formed as a unit which can be assembled with the device.

Selectively operable means are provided for removing the stick of bobbin tubes from the respective compartment at a predetermined location on the path. Selectively operable means is also provided for separating individual bobbin tubes from the stick of tubes after the removal of the stick from its respective compartment. The thus separated tubes can then be individually transferred to respective operating stations of the yarn processing machine.

Means can be provided to rotate the stick of telescoped tubes after removal thereof from its respective compartment so as to align the longitudinal axes of the tubes of the stick in parallelism with the trajectory, if they are not already so aligned.

In the preferred embodiment, the means for moving the compartments comprises an elevator structure, and the closed path extends generally upwardly in use, being transverse both to the trajectory and to the longitudinal axes of bobbin tubes stored in the compartments. The predetermined location is then preferably adjacent the upper end of the path. A loading position for loading the sticks of tubes into respective compartments can be provided adjacent the lower end of the path, if necessary.

The separating means for separating the individual bobbin tubes from the stick can be provided in alignment with the predetermined location or below the rotating means for aligning the tube axes with the trajectory. In the latter case, a chute may be provided to guide an aligned stick of tubes from the rotating means to the separating means.

Suitable feed means can be provided to move the separated bobbin tube from the separator means to a transfer unit for transferring it to an operating station of the processing machine.

Where the sticks of the tubes are arranged transversely to the direction of travel when carried in their respective compartments, the removing means for removing the stick of tubes from the compartment preferably comprises an element movable between a first position, in which it lies outside the closed patn and a second position in which it projects into such path. The bounding means can then be so formed that they can pass along the path even when this element is in its second position, but such that the sticks of the tubes supported within the compartment cannot pass by this element when the latter is in its second position For example, the bounding means and the element may comprise intercalating portions. When in its first position, the element may act as a retainer retaining the stick of tubes in its respective compartment as the latter moves past the element.

A control system may be provided which is sensitive to interference of the element with the respective stick of the tubes during the movement of the element from its first to its second position and the control system may be operative to cause withdrawal of the elements to its first position when such interference is sensed.

Where the sticks of the tubes are arranged in parallelism with the trajectory of travel when carried in their respective compartments, the removing means may comprise a reciprocable element adapted to move the stick of tubes longitudinally of its own axis from its compartment.

According to a further feature of the invention, a travelling service for servicing operating stations of a yarn processing machine and having a support frame adapted to travel in a predetermined trajectory may have an end face transverse to the trajectory and a bobbin magazine mounted on the end face on the frame. Hinge means may be provided connecting the magazine to the frame to enable the magazine to swing relative to the frame between a first position in which the magazine is adjacent to the end face so that at least a part of the end face of the frame is concealed by the magazine, and a second position in which the end face on the frame, or at least the part thereof that was previously concealed by the magazine, is exposed.

The invention is intended particularly, but not exclusively, for use in a travelling service device which is suspended from a rail mounted above the yarn processing machine in use so that the service device is disposed at least partially outside the contours of the processing machine as viewed in the top plan view.

The novel features which are considered as characteristic of the invention are set forth in particular in the appended claims. The improved travelling service device for yarn processing machines itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a top plan view of a rotor spinning machine equipped with a travelling service device and a suspension system therefor;

FIG. 2 is a side elevational view of the service device of FIG. 1 as viewed from the spinning machine;

FIG. 3 is a top plan view of the service device of FIG. 2, drawn to a different scale and showing more details than FIG. 1;

FIG. 4 is an end elevational view showing one end face of the service device of FIG. 2;

FIGS. 5A and 5B are respectively a side elevational view and a top plan view of a construction of a bobbin magazine in accordance with the invention to be attached at the end face shown in FIG. 4;

FIGS. 6A and 6B are diagrammatic representations of a complete system for transferring bobbins from the magazine illustrated in FIGS. 5A and 5B to the service device of FIGS. 2 to 4;

DETAILED DESCRIPTION OF THE PREFERRED EMBODIMENTS

Figure 7:
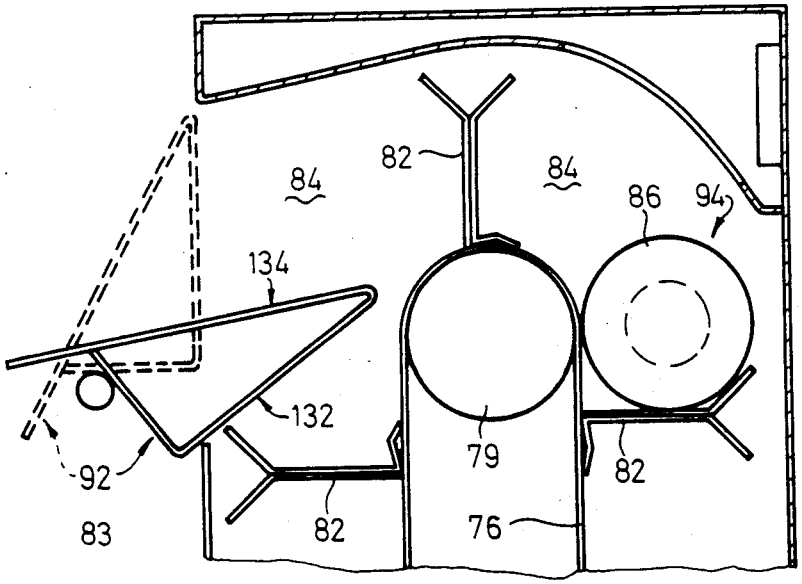
FIG. 7 is a sectional view of the upper portion of the bobbin magazine of FIG. 5A, at an enlarged scale and showing in more detail the arrangement that enables the extraction of the bobbin tubes from the magazine.

Referring now to the drawing in detail, it may be seen that FIG. 1 thereof diagrammatically illustrates a rotor spinning machine which comprises end heads 10 and 12 and two rows of spinning units 14 respectively extending along opposite sides of the spinning machine between the end heads 10 and 12. This general machine layout, and the construction of the individual spinning units or stations 14 is now very well known in the yarn spinning art, and hence will not be described further herein. Further details of one machine construction based on this layout may be seen in the U.S. Pat. No. 3,375,649, but the present invention is by no means limited to use with that particular machine construction.

Yarn newly spun at each spinning station 14 is wound up into a respective yarn package at that station. When the respective yarn package has reached a predetermined size, for example, after a predetermined length of yarn has been wound into the package, the package is transferred from the spinning station 14 to a conveyor belt 16 extending longitudinally of the machine between the rows of spinning stations 14. The package is then carried by the belt 16 to one machine end where it can be collected and passed on to a package handling system chosen by the operating spinning mill. Transfer of the package from the spinning station 14 to the belt 16 is effected by an automatic doffer which forms one unit of a multi-purpose service device indicated at 18 in FIG. 1.

The device 18 is suspended from a U-shaped rail 20 and can move in any desired direction along the rail 20 past the spinning stations 14. When all spinning stations 14 are operating normally, the device 18 performs "patrolling" movements from one rail end to the other past both machine sides. The device 18 is, however, continually inspecting the stations 14, and when it senses that an "event" has occurred at one of these stations 14, it stops in front of that station 14 and performs an appropriate service operation on the "calling" station. Doffing of a completed yarn package is one such operation. "Piecing" of a broken yarn may be another such operation. The service device 18 may also be designed to perform "preventive maintenance" involving a temporary interruption of spinning in order to clean the rotor at the spinning station 14 involved.

In addition to its automatic doffing unit, therefore, the device 18 advantageously comprises a plurality of other automatically operating units, for example a yarn piecing unit, a rotor cleaning unit and a locating system designed to control the positioning of the device 18 relative to the spinning machine. Several such multipurpose devices are now commercially available. Details of one such device, available from the assignee of the present application, have been described and illustrated in the following pending U.S. patent applications:

(a) Piecing aspects—U.S. patent application Ser. No. 611,602 filed May 18, 1984 corresponding to European Published patent application No. 127,017 published Dec. 5, 1984

(b) doffing aspects—U.S. patent application Ser. No. 611,852, filed May 18, 1984, corresponding to European Published patent application No. 126,352 published Nov. 28, 1984, now U.S. Pat. No. 4,606,508, and (c) locating aspects—U.S. patent application Ser. No. 612,068, filed May 18, 1984, corresponding to European Published patent application No. 126,373 published Nov. 28, 1984.

The contents of those prior patent applications are incorporated by reference in the present application. However, the present invention is not limited to use with devices described in those applications.

FIGS. 2 and 3 show in a considerably simplified manner the structure of the service device 18. For simplicity at this stage of the description, the device 18 has been illustrated and will be described for use with the machine constructed and operated for winding cylindrical packages or "cheeses". A modification of a bobbin magazine to enable use with a machine for winding "cones" will then be described with reference to subsequent Figures of the drawing.

The structure shown in FIGS. 2 and 3 is illustrated primarily in order to show the importance of space utilization in a multi-purpose device of this type. Accordingly, it is believed unnecessary to describe details of the illustrated devices, and attention will be concentrated upon the overall layout of the various automatic units in the service device 18. Details of some of the automatic units can, however, be obtained from the copending patent applications referred to above.

The main structural member in the device 18 is a carrier beam 22 which is mounted on the rail 20 by a suspension 24 and a drive unit 26, respectively, from which all other parts of the service device are suspended. Two further major structural elements are constituted by respective vertical bulk heads 28 and 30 which respectively divide the device 18 into left-hand, right-hand and center sections as considered in FIG. 2. The main automatic operating units are provided in the center section. These units can be considered to fall into five groups arranged vertically one above the other; a lowermost ("first") group 32 comprises units adapted to cooperate directly with the spinning components at a spinning station 14 being serviced; a second group 34 comprises units adapted to handle a yarn during threading thereof into the machine for a piecing operation; a third group 36 comprises units adapted to present a yarn to the second group 34 (for example, the group 36 comprises a suction nozzle 38 for finding a broken yarn end on a package at a spinning station 14 being serviced); a fourth group 40 comprises units used during doffing and during insertion of a fresh bobbin tube into a spinning station 14 to replace a package doffed therefrom; a fifth, and uppermost, group 42 comprises a system for feeding bobbin tubes to the group 40.

The left-hand section of the device 18 contains drive and control systems for the various units 32, 34, 36, 40 and 42 in the center section. The right-hand section contains primarily a suction system comprising an air pump 44 and a reservoir 46 the interior of which is held at low pressure by the air pump 44 and provides corresponding low pressure to various pneumatic systems in the center section of the device 18.

The main bulk of the device 18 is contained within a generally boxlike envelope of a rectangular vertical cross section delimited by two end plates 48 and 50 respectively, the end plate 48 being also shown in FIG. 4. Bars 52 secured to these end plates 48 and 50 are safety devices intended to stop travel of the device 18 if one of the bars 52 contacts an obstruction. As best seen in FIG. 3, the outwardly-facing side (that is, the side facing away from the machine) has a protective panelling 54, but the device 18 is open at its side facing the machine. At its lower edge on that side, the device 18 has rollers 56 to engage guide rails provided on the machine itself.

As best seen in FIG. 3, the device 18 is fitted at its upper end with certain parts which project inwardly over the machine. These parts include an energy pick-up 58 by means of which energy can be derived from the machine to operate the device 18. Of more direct interest in this case is a bobbin magazine 60 the floor of which is in the form of a simple inclined plane sloping from the center of the machine to a vertically disposed chute 62. Cylindrical bobbin tubes can roll down the inclined plane and drop vertically down the chute 62 to be held by a pair of legs 64 (FIG. 2) at the lower end of the chute 62. From this position they can be retrieved by a bobbin inserting device 66 which transfers the bobbins individually from the legs 64 to the spinning stations 14 of the machine. This arrangement is described in more detail in the U.S. patent application Ser. No. 611,852 referred to above and further details can be obtained from that application.

The simple bobbin feed arrangement shown in FIGS. 2 and 3 cannot be used for conical bobbins because they will not roll in a controllable fashion in the simple magazine 60. The drum-type magazine described in U.S. patent application Ser. No. 611,852 is satisfactory for normal operation of the machine where doffing operations are required relatively infrequently. However, during a start-up operation as described above, there is a relatively heavy demand for insertion of bobbin tubes into the empty spinning stations 14 in order to bring them into service. The drum-type magazine is unable to satisfy this demand without frequent topping up which reduces the efficiency of overall operation. An alternative magazine for conical bobbins, which will now be described with reference to FIGS. 4–9 renders it possible to overcome this problem.

The new magazine is to be attached to one end of the service device 18. In the illustrated embodiment, this is effected by securing the magazine to the end plate 48. The new magazine should remain as far as possible within the cross-sectional envelope defined by the end plate 48, but in order to maximize the available storage space it is desirable to utilize the entire cross section represented by that end plate 48. This gives rise to a problem, however, in that (as seen in FIG. 4) the plate 48 has a plurality of openings 68 enabling limited access to the drive systems in the left-hand section of the device 18 as viewed in FIG. 2. These openings 68 enable insertion of operating tools by means of which the drives can be operated manually in the event of a malfunction, during testing or for other reasons. In order to overcome this problem, the bobbin magazine is to be secured to the plate 48 in a manner enabling it to move relative to the plate 48 while remaining secured thereto. The magazine can be moved between an operating position, in which it conceals the plate 48, and a non-operating position in which plate 48 is exposed.

The general structure of the new magazine 70 is shown in FIG. 5, in which FIG. 5A represents a vertical section as viewed from one side, while FIG. 5B represents a top plan view. As shown there, the new magazine 70 is a generally box-like structure the dimensions of which in end view (not shown) correspond closely (but not necessarily exactly) to those of the plate 48. The magazine 70 is secured to the plate 48 (after removal of the safety bar 52 therefrom) by means of a hinge 72 provided along the entire length of the outer edge of plate 48, that is the edge furthest from the machine. A suitable releasable catch mechanism 74 (FIG. 5B, details not illustrated) is provided to secure the magazine 70 in its operating position relative to the device 18 in which one end wall 88 of the magazine 70 lies in a plane parallel to and adjacent the plate 48. When the magazine 70 is in this position, it can be operated (by means to be described below) to transfer bobbins from the magazine 70 to the main part of the device 18. When it is desired to obtain access to the plate 48, however, the catch 74 can be released and the magazine 70 can be swung about a vertical axis passing through the hinge 72 into a position in which the end wall 88 lies at right angles to the plate 48 as viewed in FIG. 5B.

The main operating element of the magazine 70 is best seen in FIG. 5A and comprises an endless belt 76 running around upper and lower drive and guide pulleys 78 and 80, respectively. Each of the pulleys 78 and 80 is mounted (by means not shown) to be rotatable about a generally horizontal axis in a counter-clockwise direction as viewed in FIG. 5A. Thus, as viewed in this FIG. 5A, the right-hand vertical run of the belt 76 travels upwardly and the left-hand vertical run travels downwardly.

A plurality of compartment-defining elements 82 is secured to the band 76 so that the elements 82 are evenly spaced along the band 76. Each element 82 is Y-shaped in cross-section, the main leg of the Y being elongated and attached to the band 76 at its foot. A compartment 84 is defined between each successive pair of the elements 82. Each compartment 84 is elongated with the longitudinal axis of the compartment 84 lying parallel to the width of the band 76, that is, substantially horizontally. The length of each compartment 84 is sufficient to hold a "stick" of telescoped, conical bobbin tubes 86 with a predetermined number of tubes 86 in the stick, for example eight tubes 86 as shown in FIG. 5B. The axial cross-section of each compartment 84 is dimensioned to leave adequate clearance around the bobbin tubes 86 (FIG. 5A) of predetermined maximum external diameter. The heads of the Y-shaped elements 82 serve to retain the sticks of the tubes 86 in their respective compartments 84 after they have been loaded into the magazine 70 and to prevent rubbing against vertical end walls 88 and 89 of the magazine 70. However, as the respective compartment 84 passes from the downwardly travelling run to the upwardly travelling run of the belt 76, the stick of tubes 86 accommodated in that compartment 84 is permitted to roll on a curved guide plate 90 (FIG. 5A) which forms the lowermost surface of the magazine 70. A hatch 91 in the guide plate 90 can be released to permit unloading of the magazine 70 by hand, if required.

The magazine 70 is illustrated in FIG. 5 in a condition in which it is being loaded from the completely empty state. It will be assumed that the loading of the magazine 70 is effected manually, although it is also contemplated to effect automation of this loading step. For the loading operation, a door 92 (FIG. 5B) supported on a hinge 93 arranged at the side of the magazine 70 facing away from the machine is opened. This provides access to the compartments 84 so that it is easy to insert a stick of the tubes 86 by axial movement thereof. A drive (not shown) can drive the belt 76 in the counter-clockwise direction, or the system can be driven manually, so as to enable insertion of the sticks of the tubes 86 into the respective compartments 84 near the lower end of the elevator. The endless belt 76 defines a closed path of movement for the compartments 84, and in FIG. 5A it is assumed that the first-inserted stick of tubes 86 has passed along this path to a stage at which it is ready to pass from the upward to the downward run of the belt 76.

As can also be seen in FIG. 5A, the compartment 84 at the upper end of the downward run of the belt 76 is thereby slightly enlarged, so that this is in a suitable position along the path of travel to effect removal of the sticks of the tubes 86 from the magazine 70. Removal means operating at this point in the path will be described later. In the assumed circumstances, however, in which the magazine 70 is being loaded, the removing system is rendered inoperative and effectively closes off the casing of the magazine 70 as illustrated in FIG. 5A. Thus the loading operation can continue, with passage of the already loaded sticks of the tubes 86 from the upward to the downward run of belt 76, and the service device 18 can finally be sent into service operation with a stick of the tubes 86 in each compartment 84 of its magazine 70.

The general advantages of this arrangement can be seen in FIG. 5. The total length of the device 18 in its direction of travel is increased (by addition of the magazine 70) by little more than twice the maximum bobbin external diameter plus the diameter of the pulleys 78 and 80. However, virtually the full cross-sectional area of the device 18 is exploited by each of the two runs of the belt 76. In particular, the full width of the belt 76, and hence almost the full width of the device 18, can be exploited for storage purposes.

If the weight of the fully loaded magazine 70 is too much for the suspension of the device 18 to bear, then the magazine 70 can be provided with its own separate suspension for cooperation with the rail 20, and a tow connection can be provided between the device 18 and the separately suspended magazine 70.

There is an associated problem, in that the bobbin tubes 86 are now oriented at right angles to the length of the machine, whereas each tube 86 must be aligned longitudinally of the machine at the time it is inserted into its respective spinning station 14. A system for enabling this will now be described in broad outline with reference to FIG. 6.

FIG. 6A illustrates once again in highly diagrammatic form the upper portion of the magazine 70; in this case, no attempt has been made to represent the actual physical structure involved since only the operating principle is of interest in FIG. 6. A construction enabling the principles of FIG. 6 to be put into effect will be described later with reference to FIGS. 7 to 9. Similar remarks apply to other elements shown in FIG. 6B which are provided on the service device 18.

As indicated in FIG. 6A, a pivotable door 92 is provided in the upper portion of the casing wall 88 facing the end plate 48. When the door 92 is pivoted to a closed position (shown in dotted lines in FIG. 6A),it closes the casing of the magazine 70 so that no tubes 86 are extracted, for example during loading as described with reference to FIG. 5A. When, however, the door 92 is pivoted to project into the magazine 70 (shown in full lines in FIG. 6A), a stick 94 of tubes 86 in the compartment 84 then situated at the upper run of the belt 76 can roll out of the compartment 84 and down the inclined door 92 into the service device 18. In this respect, it is to be noted that, although an individual conical bobbin tube 86 will not roll in a readily controllable manner, a telescoped stick 94 of such tubes 86 will roll controllably at least over a short distance, which is sufficient for the present system.

When the newly extracted stick 94 (FIG. 6A) reaches the lower end of the door 92, it falls therefrom into an open-topped oblong box 96 which is seen in elevation in FIG. 6A and has been illustrated again in plan view in FIG. 6B.

The box 96 is mounted on a carrier 98 which is pivotable about a vertical axis defined by a pivot pin 100. The carrier 98 can be pivoted through a quarter-circle, so that the box 96 adopts the dotted line position shown in FIG. 6B. The complete stick 94 is therefore now oriented longitudinally of the machine (and of the direction of travel of the device 18).

While maintaining this new orientation, the stick 94 is now transferred to a bobbin tube separating device generally indicated at 102. The means enabling this transfer will be described later with reference to FIG. 9. The tube separating device 102 is of a generally known type, similar to that described in the U.S. Pat. No. 4,066,218. Accordingly, only the broad principles will be described in this description.

In FIG. 6B, the device 102 is shown in its condition of readiness to separate a "first" or "leading" tube 86L of the stick 94 from the rest of the stick 94. In this condition, the second tube of the stick 94 is clamped adjacent its maximum diameter end ("foot") by a pair of clamping elements 104. A separator finger 106 engages the axial end face on the foot of the leading tube 86L. The finger 106 is pivoted at 108, and when the finger 106 is pivoted in a clockwise direction (as viewed in FIG. 6) around its pivot 108, it urges the tube 86L to the left and away from the clamped tube 86 and the remainder of the stick 94. The finger 106 has only a short stroke of movement, sufficient to ensure that the leading tube 86L is freed from the remainder of the stick 94. The movement of the freed tube 86L to the upper end of the chute 62 (see also FIGS. 2 and 3) is effected by a pusher 110 which also engages the axial end face at the foot of the leading tube 86L but which has a relatively long operating stroke compared with that of the finger 106.

When the leading tube 86L reaches the chute 62, it falls into the chute 62 and onto a releasable control plate (not shown). When the plate is moved to unblock the chute 62, the tube 86L can fall onto the holder legs 64 (see also FIG. 2) ready for collection by the inserting element 66 (FIG.2). Details of the chute 62 are provided in the U.S. patent application Serial No. 611,852 referred to above, and form no part of the present invention, so that further description will be confined to the system only up to the pusher 110.

When the pusher 110 has been operated to move the first tube 86L away from the remainder of the stick 94, the clamping elements 104 are retracted so as to free the stick 94 for movement towards the left as viewed in FIG. 6. At the same time, a pivotally-mounted end stop 114 rises (as viewed in FIG. 6B) into alignment with the stick 94; the end stop 114 is connected by a suitable linkage to the clamping system, so that the stop 114 is moved to its operative position automatically as the clamping elements 104 are retracted, and is withdrawn from its operative position automatically as the clamping elements 104 are engaged. The stick 94 is continuously urged to the left as viewed in FIG. 6B by a spring-biased forwarding member 116 which engages the foot of a trailing bobbin tube 86T. Accordingly, the stick 94 moves to the left until the previously clamped tube 86 engages the end stop 114, when it is located in the position previously occupied by the leading tube 86L. The system is therefore now ready for a repeat operation.

It is believed that the operating devices for effecting the operations described with reference to FIG. 6 will be readily apparent from that Figure, and they will therefore be referred to only very briefly. The door 92 is operated by a cylinder-and-piston unit 118 which is spring-biased to urge the door 92 into its closed condition in which the bobbin tubes 86 cannot be extracted from the magazine 70. The box 96 is moved by a cylinder-and-piston unit 120 which is spring-biased to urge the box 96 into its position to receive a stick 94 of the tubes 86 falling from the door 92.

The clamping elements 104 are operated by a double-acting cylinder-and-piston unit 122, and the pivotable end stop 114 is operated by the same unit 122 because of the linkage described above. The finger 106 and the pusher 110 are operated by respective, individual, double-acting cylinder-and-piston units 124 and 126, respectively, the unit 126 having a substantially longer operating stroke than the unit 124. A biasing spring urging the forwarding member 116 to the left as viewed in FIG. 6 is indicated at 128 and the forwarding member 116 can be withdrawn to a "full-right" position against the bias of the spring 128 by means of a single-acting cylinder-and-piston unit 130.

The control of the pressurization of the unit 118 is effected by a valve V1. The control of the pressurization of the unit 120 is effected by a valve V2. The control of the pressurization of the unit 130 is effected by a valve V3. The control of the pressurization of the double-acting units 122, 124 and 126 is effected by respective valves V4, V5 and V6.

FIG. 7 substantially corresponds to FIG. 5A and thus most elements will not need detailed description. The main point to be noted in this respect is that the pivotable door 92 has a head portion providing a closure face 132 and a extractor face 134. When the door 92 is pivoted fully in the counter-clockwise direction as viewed in FIG. 7, the face 132 forms a continuation of the casing wall 88 so that the sticks 94 of the tubes 86 are retained in the magazine 70. When the door 92 is pivoted fully in the clockwise direction (full line position in FIG. 7), the face 134 provides an inclined plane projecting into the uppermost compartment 84 on the downward run of belt 76 to enable extraction of the respective stick 94 of the tubes 86 as already described above with reference to FIG. 6.

Figure 8:
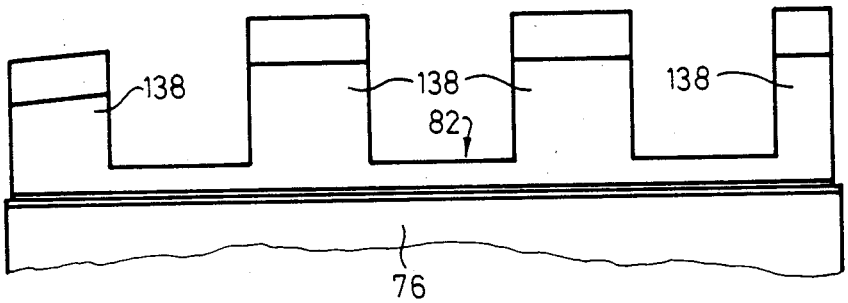
FIG. 8 is a fragmentary view of a detail of FIG. 7, drawn to a different scale.

It is desirable to enable the elements 82 to pass by the door 92 even when the latter is in its extraction position. For this purpose, the free ends of the elements 82 are provided with recesses 136 (FIG. 8) so that the head of each element 82 is not continuous across the entire width of the belt 76 but is constituted by a plurality of projecting fingers 138. As seen in FIG. 8, the left hand finger 138 is shorter to allow for the conicity of the foremost tube 86L in the stick 94. The head portion on the door 92 is made correspondingly discontinuous so that the fingers (not shown) on the door 92 correspond to the recesses 136 in the elements 82. The clearances are made such that the elements 82 can pass by the door 92 without interference. However, a stick 94 of the tubes 86 carried by an element 82 passing from the upward to the downward run of the belt 76 will extend longitudinally across the fingers of the door 92 and will be collected thereby as the corresponding compartment 84 reaches the downward run of the belt 76.

It is preferred to re-close the door 92 at the completion of each extraction operation. The belt 76 can then be driven at any time that the door 92 is closed, for example for inspection or loading operations. In order to avoid complications, no particular steps are taken to ensure that the belt 76 stops in any particular disposition relative to the door 92. Accordingly, when an attempt is made to open the door 92, there may be a stick 94 of the tubes 86 resting on the uppermost element 82 on the downward run of the belt 76 and this stick 94 will then interfere with the opening of the door 92. Means can be provided to sense such interference and to cause the belt 76 to move forward sufficiently to permit the opening of the door 92.

Figure 9:
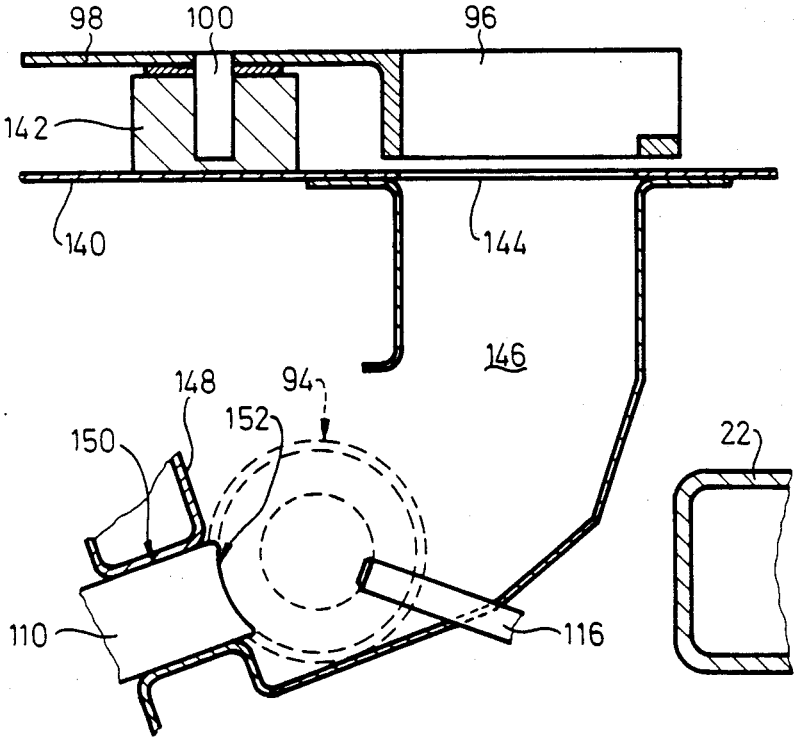
FIG. 9 is a cross-sectional view of an arrangement in the service device which receives the bobbins from the magazine and prepares them for transfer to individual operating stations.

FIG. 9 shows the carrier beam 22 and a horizontal plate 140 supported (by means not shown) slightly above the beam 22 when the device 18 is suspended from the rail 20 in use. The plate 140 carries a boss 142 rotatably supporting the pivot pin 100 that has been previously mentioned in connection with FIG. 6. The carrier 98 (see also FIG. 6) is mounted on the pin 100 so that the box 96 (see also FIG. 6) is spaced slightly from the plate 140 for movement relative to the plate 140 without interference. The position illustrated in FIG. 9 corresponds to the dotted line position in FIG. 6, that is, with the length of the elongated box 96 aligned with the direction of travel of the device 18.

As already described with reference to FIG. 6, the box 96 is open-topped so that it can receive a stick 94 falling from the door 92. The box 96 also has no bottom, so that the stick 94 falls directly onto the plate 140. The position of the stick 94 relative to the plate 140 is, however, restrained by the side walls of the box 96. As the box 96 pivots from its full line position shown in FIG. 6 into the dotted line position, the stick 94 is forced to slide over the plate 140. However, as seen in FIG. 9, the plate 140 has an opening 144 in alignment with and dimensioned to correspond with the box 96 when the latter is in the position shown in FIG. 9. The stick 94 of the tubes 86 thus falls through the opening 144 in the plate 140 into a short chute 146.

The stick 94 first falls and then rolls down the wall of the chute 146 until it hits a stop wall 148 approximately at the elevation of the carrier beam 22. In this position, the stick 94 is at rest in the separator device 102. At this time, the forwarding member 116 is fully withdrawn (to the right as shown in FIG. 6B) to ensure that the stick 94 of the tubes 86 can roll into the required position in the separator 102 without interference from the forwarding member 116. As soon as the stick 94 of the tubes 86 is in the desired position in contact with the wall 148, the cylinder-and-piston unit 130 is operated to move the forwarding member 116 forward (to the left as viewed in FIG. 6B) so as to urge the stick 94 of the tubes 86 forward until the front tube 86L engages the retainer 114. In this position, as shown in FIG. 6B, the pusher 110 engages just behind the foot of the foremost tube 86L.

As shown in FIG. 9, the pusher 110 extends through an opening 150 forming a guideway in the wall 148. The pusher 110 has a shaped lip 152 which enables it to engage behind the foot of the foremost tube 86L without interference with the second tube 86 (if any) in the stick 94. During the return movement of the pusher 110, after it has delivered the foremost tube 86L of the stick 94 to the chute 62 (FIG. 6B), the pusher 110 must ride over the foot of the next tube 86 in the stick 94 which in the meanwhile will have moved forward into engagement with the retainer 114. As will now be described, means is provided to enable the pusher 110 to move radially outwardly relative to the stick 94 of the tubes 86 in order to enable it to ride over the foot of the respective next tube 86.

The last-mentioned means is illustrated diagrammatically in FIG. 6B, since it is believed that details of the system are not essential to this description. Thus, the cylinder of the unit 126 has a pivot mounting 154 at its end remote from the pusher 110. The mounting arrangement 154 cooperates with a corresponding portion (not shown) secured in the frame of the device 18 to enable the cylinder of the unit 126 to pivot about an axis contained within the mounting arrangement 154 and extending at right angles to the plane of the drawing in FIG. 6B. A compression spring 156 is provided extending between the frame and the cylinder, urging the latter in a clockwise direction (as viewed in FIG. 6B) around the pivot axis in the mounting arrangement 154. A suitable stop (not shown) is provided to limit this "clockwise" rotation of the unit 126 and thus to limit the movement of the lip 152 of the pusher 110 towards the stick 94 of the tubes 86. The stop is positioned to permit the pusher 110 to engage behind a tube foot as illustrated in FIG. 9. When the lip 152 engages the foot of a tube 86 during a retraction movement, the cylinder-and-piston unit 126 can swing counter-clockwise (as viewed in FIG. 6B) around the pivot axis in the mounting arrangement 154 against the bias of a compression spring 156. As soon as the lip 152 has passed over the tube foot, however, the spring 156 again urges the unit 126 in a clockwise direction so that the pusher 110 engages behind the tube foot. Correspondingly, as a new stick 94 of the tubes 86 is pushed forward against the retainer 114 by the forwarding member 116, the unit 126 can pivot on the mounting arrangement 154 to permit the pusher 110 to ride over the foot of the foremost tube 86L.

Figure 10:
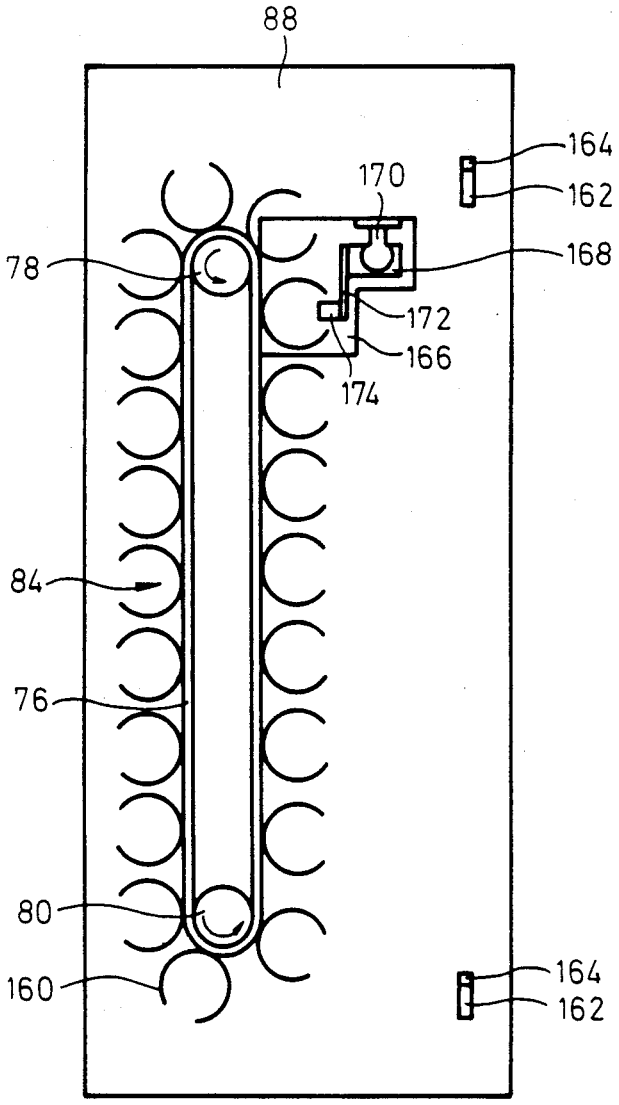
FIG. 10 is a diagrammatic end elevational view of a modified construction of the bobbin magazine of the invention.
Figure 11:
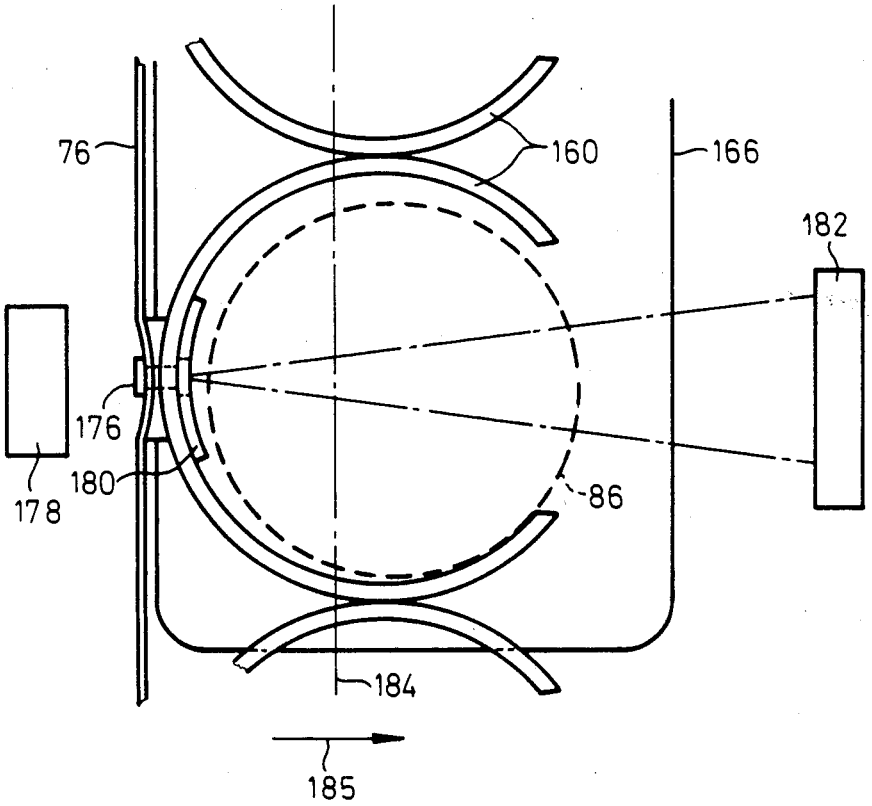
FIG. 11 is a view of one detail of FIG. 10.
Figure 12:
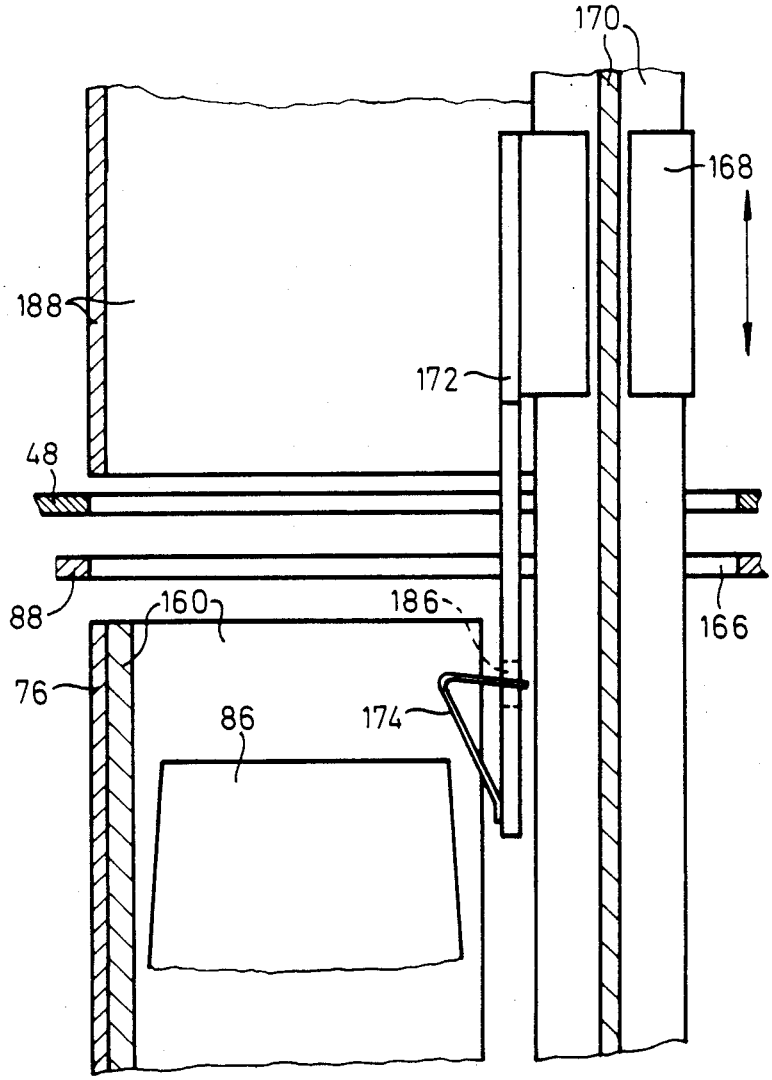
FIG. 12 is a view of another detail of FIG. 10.

A modified embodiment is illustrated in FIGS. 10 to 12. Elements similar to those already described are indicated by the same reference numerals. In this case each compartment 84 is formed by a C-shaped element 160 secured to the belt 76 at a location on the C diametrically opposite the opening therein. The major difference with respect to the first embodiment is to be seen in the disposition of the axes of the belt drive pulleys 78 and 80—and hence the longitudinal axes of the compartments 84. As seen in the end elevation in FIG. 10, these axes now extend at right angles to the end face 88 which is parallel to the end plate 48 (FIG. 4) of the service device 18. The end plate 48 cannot be seen in FIG. 10 because it is concealed behind the plate which forms the magazine end face 88.

In this modified construction, the plate 88 forms a support and mounting structure for the magazine 70, being secured at its left hand edge (as viewed in FIG. 10) to the end plate 48 by a hinge arrangement (not seen in FIG. 10) similar to the hinge 72 shown in FIG. 5A. Hook elements, the heads of which can be seen at 162 in FIG. 10, extend from the service device 18 through openings 164 in the plate 88 and secure the latter in its operating position parallel to the plate 48. As before, the catches formed by the hooks can be released to permit the plate 88 to be swung away from the plate 48 to expose the latter. The pulleys 78 and 80 project in a cantilever fashion from the mounting plate 88.

The plates 48 and 88 each also have an inverted L-shaped opening 166 through which the sticks 94 of the tubes 86 (not shown in FIG. 10) can be transferred from the magazine 70 into the service device 18 by movement longitudinally of the compartment (and stick-/tube) axes. This transfer is effected by a runner 168 reciprocable on a rail 170 mounted in the service device 18 and extending parallel to the compartment/stick axes.

The runner 168 carries an arm 172 projecting downwardly therefrom on the side facing the compartments 84. At its lower end, the arm 172 carries a spring finger 174 which, as shown in FIG. 10, can project into the compartment 84 of a suitably located element 160.

The rail 170 extends sufficiently far out from the plates 48 and 88 to enable the runner 168 to carry the spring finger 174 past the outboard end (i.e. the end remote from the plate 88) of a stick 94 of the tubes 86 carried by the compartment 84 in the unloading position (i.e. the position in which the finger 174 projects into that compartment 84). When the respective compartment 84 to be unloaded first arrives in the unloading position, the runner 168 is retracted so that the finger 174 is contained within the service device 18. After the compartment 84 has been correctly located (as will be described), the runner 168 is moved outwardly along the rail 170 carrying the finger 174 to its outboard position, past the stick 94 of the tubes 86. As seen in FIG. 10, the arm 172 lies wholly outside the element 160, only the finger 174 projecting into the compartment 84. The finger 174 engages the tubes 86 in the compartment 84 as it moves past them. The stick 94 must be so oriented that the tips of the tubes 86 (the narrower ends) lie closer to the plate 88 than their wider ends. The spring in the finger 174 enables it to move outwardly over the foot of each tube 86 in the stick 94 until it engages behind the foot of the outboard tube 86 in the stick 94. During the return movement of the runner 168 into the service device 18, the finger 174 engages the foot of the outboard tube 86 and draws the stick 94 into the service device 18 where it is received by a channel-shaped receiver element (not seen in FIG. 10). A suitable runner and rail structure 168 and 170 is supplied by Festo Maschinenfabrik G. Stoll, D-73 Esslingen 1, Berkheim, West Germany, under the type number DFO-PPV-A.

FIG. 11 shows in section a detail of the system described with reference to FIG. 10, namely the element 160 in the unloading position. The element 160 is secured to the belt 76 by rivets 176. A sensor device 178 is located adjacent the belt 76 to respond to the heads of the rivets 176. The sensor device 178 provides a signal to a microprocessor control system (not shown) which controls the operation of a drive motor (not shown) rotating the pulley 78. Thus, movement of the belt 76 can be stopped with a compartment 84 in the unloading position accurately aligned with the opening 166 and the finger 174. The drive motor can be provided in the service device 18 and a connector drive shaft (not shown) then extends through the plates 48 and 88 to the pulley 78.

Secured to the interior of each C-shaped element 160 opposite the opening therein is a reflector 180. A photosensor device 182 having a light beam emitter and receiver is located opposite the opening of the C-shaped element 160 so that the beam from the device 182 is reflected by the reflector 180 if the compartment 84 situated in the unloading position is empty. The drive motor referred to above can then be operated again by the microprocessor control to move the belt 76 along until a full compartment 84 is in the unloading position. Then, the light beam from the device 182 cannot reach the reflector 180 because of the intervening stick 94 of the tubes 86 indicated in dotted lines in FIG. 11.

As seen in FIG. 11, the C-shaped element 160 extends sufficiently far around the periphery of the sticks 94 of the tubes 86 to ensure that the stick 94 is retained by the element 160 as the latter passes around the lowermost part of the path defined by the belt 76. In order to reduce weight, a housing around the elevator formed by the belt 76 and pulley system 78 and 80 can be omitted. However, in order to ensure that the sticks 94 are retained against axial movement out of the outboard ends of the compartments 84, a retainer plate can be mounted on the outboard ends of the shafts (not shown) of the pulleys 78 and 80. Such a plate could extend from the top to the bottom of the elevator, extending part-way across the cross section of each compartment 84—for example as far as a dotted line 184 indicated in FIG. 11. Loading of the sticks 94 can be effected by distorting the belt 76 in the direction of an arrow 185 to a degree sufficient to move the section of one compartment 84 to a position clear of the retainer plate as viewed in end elevation. This enables insertion of a stick 94 by movement along the compartment axis. The belt 76 must of course have the necessary flexibility. Such loading can be performed by hand.

FIG. 12 shows in sectioned plan view a further detail of the system shown in FIG. 10, namely at the region of the plates 48 and 88. The runner 168 is assumed to be moving towards the outboard end of the rail 170 (downwardly as viewed in FIG. 12) and the finger 174 is about to engage the tip of the inboard tube 86 of the stick 94 in the compartment 84 to be unloaded. As seen in FIG. 12, the finger 174 can be formed as a leaf spring secured to the arm 172 at its outboard end and forming a "wedge" increasing in size in the inboard direction. The inboard end of the spring 174 is bent to pass through a slot 186 in the arm 172. As the wedge structure provided by the spring 174 engages the tip of the tube 86, the bent end of the spring 174 is forced through the slot 186 so that the wedge effect is reduced and the spring 174 rides over the tube 86.

When the spring 174 passes beyond the foot of the outboard tube 86, it returns to its illustrated condition in which the inboard end of the spring 174 will catch behind the tube foot on the return stroke of the runner 168. Alternative spring devices could, of course, be devised.

FIG. 12 also shows one side wall and the bottom of a receiver channel 188 provided in the service device 18, the other side wall being hidden beneath the rail 170. The channel 188 extends as far as the top of the chute 62 (FIG. 3) into which the bobbin tubes 86 can be pushed by movement along the channel 188 after they have been separated from the stick 94. A separating mechanism identical with that described with reference to FIG. 6 is located in a separating zone (not shown) of the channel 188 between the chute 62 and the channel portion shown in FIG. 12. The rail 170 extends at least so far into the service device 18 that the arm 172 can draw a stick 94 of the tubes 86 into the separating zone. In priciple, the arm 172 could also be used to draw separated tubes 86 from the separating zone to the chute 62, but this would necessitate the provision of additional means to operate the spring 174 to enable it to pass the stick 94 in the separating zone to a position at which it could engage behind a separated tube 86. It will often be simpler to use the separate pusher 110 (FIG. 6) for this purpose. As can be seen from FIG. 12, the arm 172 is bent below the runner 168 and extends outboard therefrom, so that the rail 170 needs to extend only part-way along each compartment 84.

It will be understood that each of the elements described above, or two or more together, may also find a useful application in other types of arrangements differing from the type described above.

While the invention has been illustrated and described as embodied in a travelling service device for servicing operating stations of a yarn processing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. A travelling service arrangement for servicing operating stations of a yarn processing machine, comprising support means; means for guiding said support means for travel in a predetermined trajectory along the operating stations; means for moving said support means in said trajectory into predetermined positions at the operating stations; means for bounding a plurality of compartments each adapted to receive a stick of conical bobbin tubes telescopically nested within one another; means for mounting said bounding means on said support means for movement in a closed path extending in a plane substantially normal to respective longitudinal axes of said compartments and of the sticks received therein, and so that said longitudinal axes extend substantially horizontally and substantially normal to said trajectory; selectively operatable means for removing the respective stick from the associated compartment when the latter is situated at a predetermined location of said path, including means for turning the respective stick after its removal from said associated compartment into a position in which said longitudinal axis thereof is still substantially horizontal but extends substantially parallel to said trajectory; and selectively operatable means for separating individual tubes from the respective stick that has been removed from said associated compartment.

2. A travelling service arrangement for servicing operating stations of a yarn processing machine, comprising a support having an end wall extending along a predetermined plane; means for guiding said support for movement in a predetermined trajectory substantially normal to said predetermined plane along the operating stations; means for moving said support in said trajectory along the operating stations; a bobbin magazine; and means for mounting said bobbin magazine on said support for movement between a first position in which said bobbin magazine extends along and conceals at least a part of said end wall, and a second position in which said bobbin magazine is distant from said part of said end wall and exposes the same while remaining mounted on said support.

3. The arrangement as defined in claim 2, wherein said mounting means mounts said bobbin magazine on said support for pivoting between said first and second positions.

4. The arrangement as defined in claim 2, wherein said mounting means mounts said bobbin magazine on said support for pivoting about a substantially vertical axis between said first and second positions.

5. The arrangement as defined in claim 4, wherein said end plate has two vertical edge portions one of which is closer and the other more remote from the stations; and wherein said mounting means is situated at said other edge portion.

6. The arrangement as defined in claim 2, and further comprising releasable locking means for securing said bobbin magazine in said first position thereof.

7. The arrangement as defined in claim 2, wherein said bobbin magazine includes means for bounding a plurality of compartments adapted to receive respective bobbin tubes, and means for mounting said bounding means on said support for movement in a closed path extending in a plane substantially normal to respective longitudinal axes of said compartments and of the bobbin tubes received therein, and so that said longitudinal axes extend substantially horizontally.

8. The arrangement as defined in claim 7, wherein said bounding means has two elongated runs extending transversely of said trajectory, and two connecting portions interconnecting said runs.

9. The arrangement as defined in claim 8, wherein said connecting portions extend substantially parallel to said trajectory.

10. The arrangement as defined in claim 9, wherein said end wall has a width and a height; and wherein said bounding means has a width substantially equal to said width of said end wall and said runs have a length substantially equal to said height of said end wall, so that said end wall is substantially completely concealed by said bobbin magazine when the latter is in said first position thereof.

* * * * *